United States Patent [19]

Kurita et al.

[11] Patent Number: 4,794,659

[45] Date of Patent: Jan. 3, 1989

[54] FLUID BED SYSTEM

[75] Inventors: Masaya Kurita; Katsuya Kanzaki, both of Kanagawa, Japan

[73] Assignee: Fuji Electric Company Ltd., Kanagawa, Japan

[21] Appl. No.: 810,202

[22] Filed: Dec. 18, 1985

[30] Foreign Application Priority Data

Dec. 19, 1984 [JP] Japan ..... 59-267645

[51] Int. Cl.[4] ..... A47C 27/08

[52] U.S. Cl. ..... 5/453; 5/469

[58] Field of Search ..... 5/453, 456, 454, 450, 5/449, 468, 469

[56] References Cited

U.S. PATENT DOCUMENTS

| | | | |
|---|---|---|---|
| 3,166,799 | 1/1965 | Birnkrant | 5/453 |
| 3,426,373 | 2/1969 | Scott et al. | 5/456 |
| 3,428,973 | 2/1969 | Hargest et al. | 5/449 |
| 3,667,705 | 6/1972 | Ballard et al. | 5/67 |
| 3,775,781 | 12/1973 | Bruno et al. | 5/456 |
| 3,866,606 | 2/1975 | Hargest | 5/453 |
| 3,950,799 | 4/1976 | Frank | 5/456 |
| 4,114,214 | 9/1978 | Von Heck | 5/450 |
| 4,225,989 | 10/1980 | Corbett et al. | 5/453 |
| 4,279,044 | 7/1981 | Douglass | 5/453 |
| 4,481,686 | 11/1984 | Lacoste | 5/453 |
| 4,609,854 | 9/1986 | Yamamoto et al. | 5/453 X |
| 4,637,083 | 1/1987 | Goodwin | 5/453 |
| 4,642,825 | 2/1987 | Kurita | 5/453 |

FOREIGN PATENT DOCUMENTS

| | | | |
|---|---|---|---|
| 526427 | 6/1956 | Canada | 5/68 |
| 0072240 | 2/1983 | European Pat. Off. | 5/60 |
| 2249013 | 7/1974 | Fed. Rep. of Germany | 5/453 |
| 2416479 | 11/1974 | Fed. Rep. of Germany | 5/368 |
| 2546404 | 11/1984 | France | 5/453 |
| 1564271 | 4/1980 | United Kingdom | 5/453 |

*Primary Examiner*—Alexander Grosz
*Assistant Examiner*—Michael F. Trettel
*Attorney, Agent, or Firm*—Finnegan, Henderson, Farabow, Garrett, & Dunner

[57] ABSTRACT

A system for fluidizing a plurality of fluid beds is shown. The system is characterized by an air supplying unit for providing all the fluid beds with pressurized air via pressurized-air supplying pipes. The supply of pressurized air to the fluid beds is controlled by manually or electrically actuated valves. The valves may be selectively opened or closed, or they may be automatically controlled to periodically open and close.

7 Claims, 6 Drawing Sheets

FLUID BED SYSTEM

BACKGROUND OF THE INVENTION

1. Field of the Invention

This invention relates to a system having a plurality of "fluid beds" as found in hospitals or the like. Fluid beds are formed of fine beads which flow when pressurized air jets upwardly through the beads from a diffusion board under the beads. When the beads are fluidized, a human body may be held by the beads in a floating manner on the bed for medical treatment or the like.

2. Description of the Related Art

FIG. 5(A) is a sectional view showing the construction of a conventional fluid bed and FIG. 5(B) is a sectional view showing the fluid bed in operation. Fluid beds of the type shown in FIG. 5 are often operated in groups.

Referring to FIG. 5(A), an air supplying device 9, comprising a ring compressor, is adapted to receive air from outside, pressurize the air and supply the air thus pressurized into a closed chamber 3. The pressurized air, the temperature of which has been raised by the pressurizing operation of the air supplying device 9, is cooled down to a predetermined temperature by a heat exchanger 11 provided in the pressurized air-supplying path. A cooling fan 10 is provided for supplying heat exchanging air to the heat exchanger 11. In the closed chamber 3, the pressurized air A1 supplied thereto through an air duct D from the heat exchanger is spread under a diffusion board 2. The diffusion board 2 is a plate made of porous material. The pressurized air A1 in the closed chamber 3 is exuded and diffused, as exudation air A2, through a large number of fine holes in the diffusion board 2. A mattress 4 which is formed from fine particles such as beads 4*a* which are caused to flow by the exudation air A2. The mattress will be referred to as "the bead mattress 4," when applicable. A cloth sheet S whose mesh is smaller than the size of the beads covers the upper surface of the bead mattress. The exudation air A2 can pass through the cloth sheet S, while the beads 4*a* are contained by the sheet S, i.e., the provision of the cloth sheet S prevents the beads 4*a* from scattering outside the fluid bed body 1.

Further in FIG. 5(A), bead pipes 5 and 7 are provided for supplying beads into the bead mattress or for removing the beads therefrom, and a bead valve 6 is provided for opening and closing the bead pipes 5 and 7.

Use of a fluid bed can prevent the blood circulatory disturbance which may occur when the human body is locally pressed. Therefore, fluid beds are used for accelerating the regeneration of the skin of patients who have been heavily burnt, or for preventing "bedsores" on long-term bedridden patients. When on the bead mattress 4, the patient's whole body is supported by substantially uniform pressures, such that the body surface pressure at individual pressure points is minimized. Accordingly, the pressure applied to the skin is reduced. In addition, because the fluctuation in pressure distribution is small, blood circulatory disturbance which may be caused when a vein is pressed is prevented.

FIG. 5(B) shows an example of a human body supported, in a floating manner, on the fluid bed of FIG. 5(A). The human body BH is supported on the bead mattress 4 such that the body sinks in the mattress to the maximum extent allowed by the medical treatment. The equivalent specific gravity of the bead mattress when the beads are flowing is about 1.29 under which condition the body BH sinks as shown in FIG. 5(B). Accordingly, as the body sinks in the bead mattress 4, the human body BH is supported by a larger contact area thereby reducing the body surface pressure.

Fluid beds are operated according to two methods: (1) a continuous fluidizing method, and (2) an intermittent fluidizing method.

Method (1) is the ordinary operating method according to which the air supplying device 9 is continously operated to continuously fluidize the beads 4*a*.

Method (2) is used to prevent the unsuitable movement of the body, as is done with the application of plaster-bandage to prevent the skin from being locally pressed. When the flow of the beads is stopped, the body is caused to sink substantially in the bead mattress 4 so that the bead mattress acts as if it were a plaster-bandage. The beads 4*a* are fluidized intermittently so that the local pressure on the skin which builds while the beads are not flowing is intermittently eliminated.

In general, a number of fluid beds are installed in a hospital or the like. Because fluid beds, as shown in FIG. 5, have their own air supplying devices, the following problems are associated with their operation:

(1) Vibration and audible noise from the air supplying device 9 is transmitted to the patient on the bed and to other persons in the same room as the patient.

(2) The height of the fluid bed is increased by the size of the air supplying device 9, making it difficult for a person to get on and off the bed. This problem is especially serious because fluid beds are used primarily for medical treatment.

(3) The bed itself is heavy, and therefore it is difficult to move.

(4) The electric power requirements of the bed's air supplying device are large. Therefore, it is impossible to use a number of fluid beds in rooms with ordinary wiring of limited capacity.

(5) The bed's air supplying device comprises an electric motor. The electronic noise from the electric motor may cause other electrical equipment in the same room to operate improperly.

(6) When a number of fluid beds are used, a number of air supplying devices are employed resulting in a high total installation cost.

(7) The bed's air supplying device requires an electric source with respect to which safety measures must be provided so that the bed is safe as a medical appliance at all times.

Thus, there is a need for a fluid bed system in which vibration and noise of individual fluid beds is small, in which individual bed heights can be changed so that a person may readily get off and on the bed, and in which the weight of each bed is small. Further, there is a need for a fluid bed system in which no motor is placed in the room where the fluid bed is provided so that supplemental electric capacity is not required in the room and so that electric motor noise will not interfere with other instruments in the room. Finally, there is a need for a fluid bed system in which the number of expensive air supplying devices is smaller than the number of fluid beds.

SUMMARY OF THE INVENTION

In order to achieve the above objects, the present invention provides a fluid bed system for fluidizing a number of fluid beds. The system has fluid beds, each with bead-like members suspended in pressurized air and a bead-confining membrane. A distribution system supplies each of the beds with pressurized air and a pressurized-air supplying unit, located remote to the fluid beds, is in flow communication with the air distribution system. An air supply control mechanism is associated with each of the fluid beds for controlling air flow to the fluid beds. Preferably the air supply control mechanism includes electrically actuated valves that open and close, each valve controlling the flow of pressurized air to one of the fluid beds, and a system controller for automatically controlling the electrically actuated valves and for automatically turning the pressurized-air supplying unit on and off. It is further preferred that the fluid beds have a closed chamber with an air inlet for receiving pressurized air flow from the distribution system and a porous top through which air is diffused into the bead-confining membrane. The chamber and membrane are configured such that the minumum height at which the bed may be set substantially equals the combined vertical thicknesses of the chamber and the membrane.

DESCRIPTION OF THE PREFERRED EMBODIMENT

With reference to FIGS. 1 through 4, two preferred embodiments of the invention will be described. FIG. 1(A) and FIG. 1(B) are diagrams outlining the arrangements of two embodiments of a fluid bed system according to the present invention. More specifically, FIG. 1(A) shows the fluid bed system operating according to a continuous fluidizing method and FIG. 1(B) shows the fluid bed system operating according to an intermittent fluidizing method.

Figure 2:
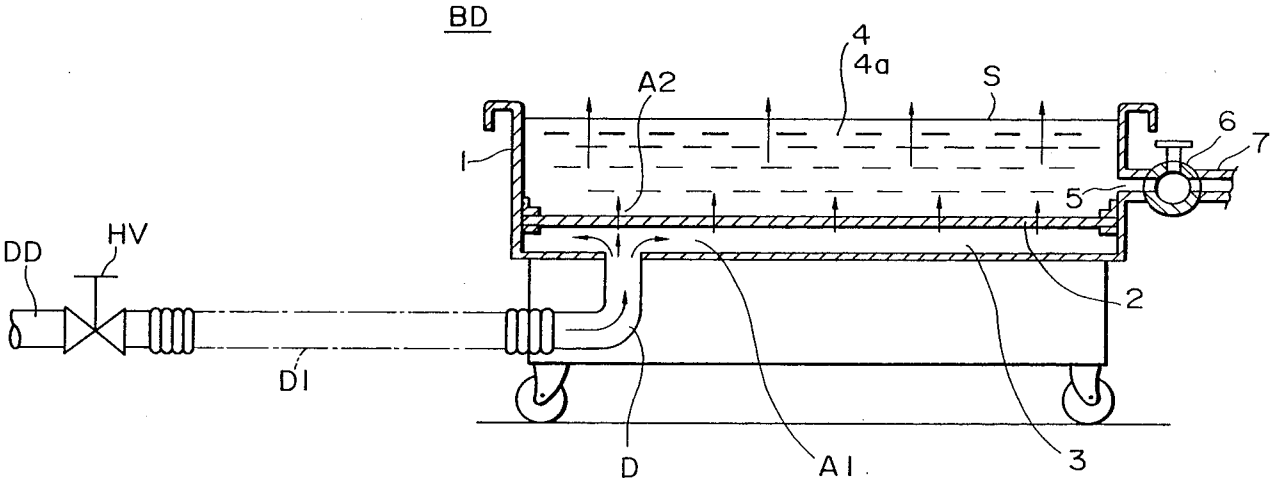
FIG. 2 is a sectional view showing one example of the structure of a fluid bed according to this invention.
Figure 5A:
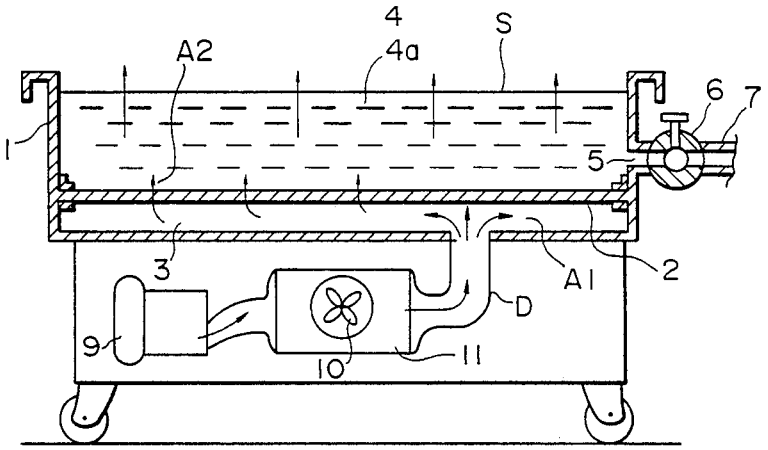
FIG. 5(A) is a sectional diagram showing the structure of a conventional fluid bed.
Figure 5B:
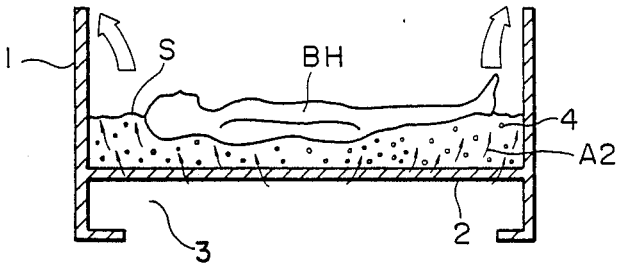
FIG. 5(B) is another sectional view of the fluid bed of FIG. 5(A) showing the fluid bed in operation.

As is apparent from a comparison between FIG. 2 and FIG. 5(A), the fluid bed BD of this invention is obtained by removing the air supplying device 9, the cooling fan 10 and the heat exchanger 11 from a conventional fluid bed and by adding a flexible air duct D1 for supplying pressurized air through a pressurized air manual valve HV provided on a pressurized air pipe DD. The duct D1 is connected to the air duct D below the bed. Removing the air supplying device 9 and the heat exchanger 11 from the conventional fluid bed allows the height of the bed to be lowered so that a patient can readily get on and off of the bed.

Figure 1A:
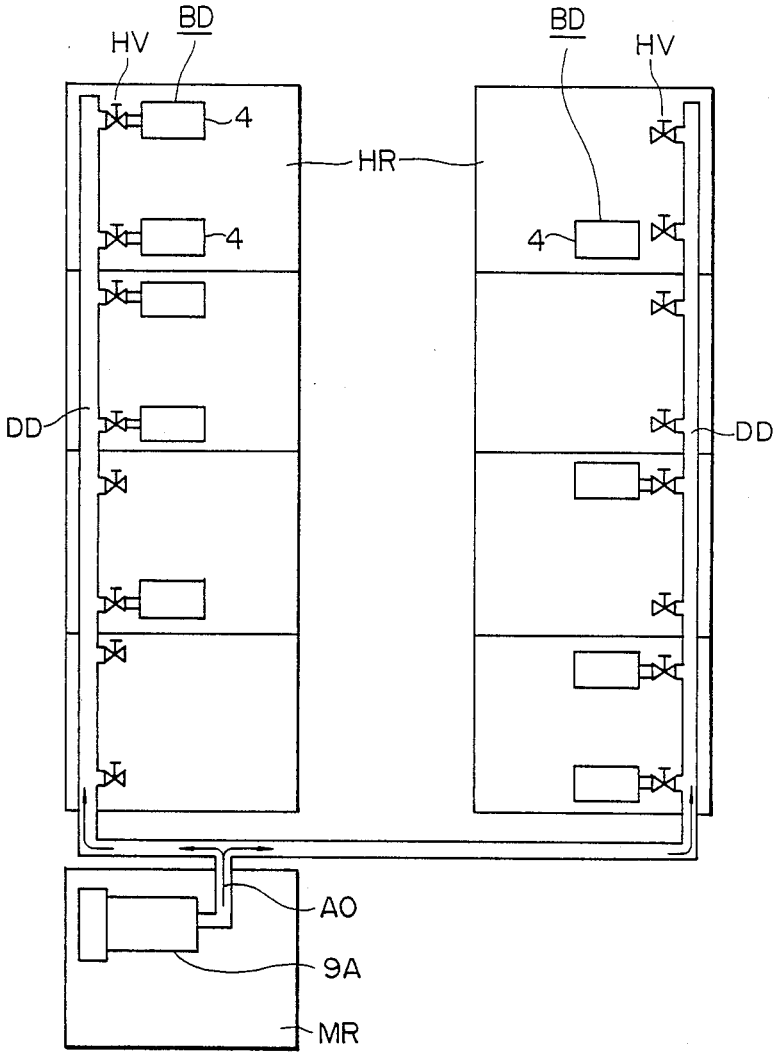
FIG. 1(A) is an explanatory diagram outlining an arrangement of a fluid bed system according to one embodiment of the invention.

As was indicated above, FIG. 1(A) shows the arrangement of a fluid bed system in which a number of fluid beds BD are installed. A central air supplying unit 9A, provided in a machine room MR, supplies pressurized air AO from the central air supply unit 9A via pressurized air pipes DD and the aforementioned manual valve HV to the fluid beds BD in the rooms. Because one air supplying unit supplies all the beds, the cost of running the system is reduced.

In this first embodiment, the beads 4*a*, in each bed 4, are fluidized by opening the respective manual valve HV to receive the pressurized air AO from the air supplying unit 9A. When fluidization of the beads is not desired or the bed is not connected to the manual valve HV, the valve HV is closed.

Figure 1B:
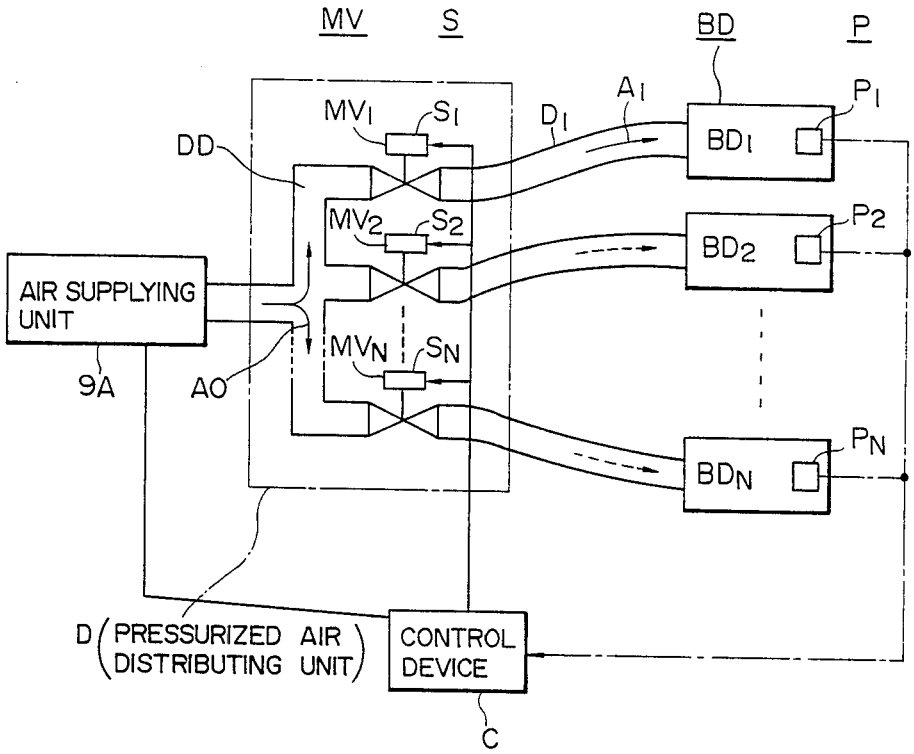
FIG. 1(B) is an explanatory diagram outlining an arrangement of a fluid bed system according to another embodiment of the invention.

FIG. 1(B) shows a second embodiment of the system operating according to the aforementioned intermittent fluidizing method in which pressurized air A1 is supplied to the fluid beds BD ($BD_1$ through $BD_N$) through electromagnetic valves MV ($MV_1$ through $MV_N$) which are cyclically opened and closed in sequence. Driving solenoids S1 through SN in the electromagnetic valves $MV_1$ through $MV_N$ are controlled by a control device C. Pressure switches $P_1$ through $P_N$ provided in the closed chambers 3 of the fluid beds $BD_1$ through $BD_N$, respectively, send signals to the control device C for controlling the solenoids S which operate the electromagnetic valves MV. If, in the embodiment, only one electromagnetic valve is operated at a time, then the capacity of the air supplying unit 9A can be reduced to that required to drive one fluid bed. For convenience in description, the equipment encircled by the broken line in FIG. 1(B) will be referred to as "a pressurized air distributing unit D," when applicable.

Figure 3:
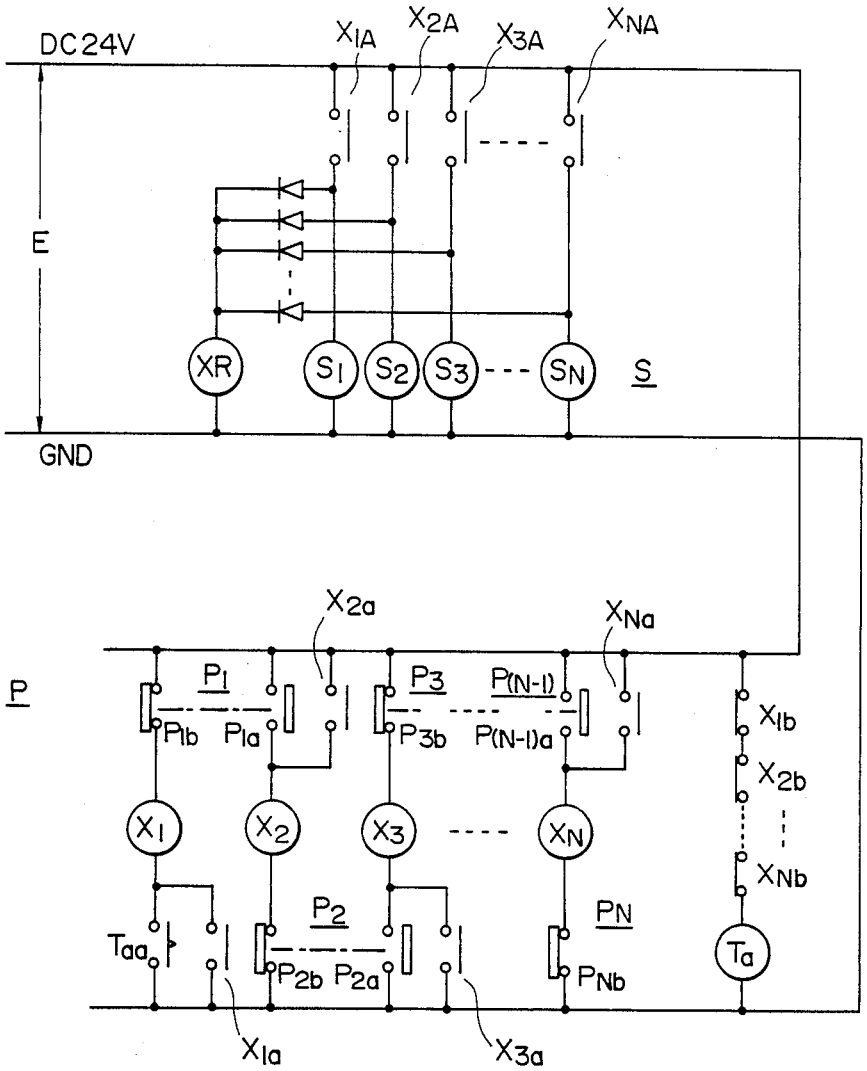
FIG. 3 is a diagram illustrating an example of a control circuit for the arrangement shown in FIG. 1(B).
Figure 4:
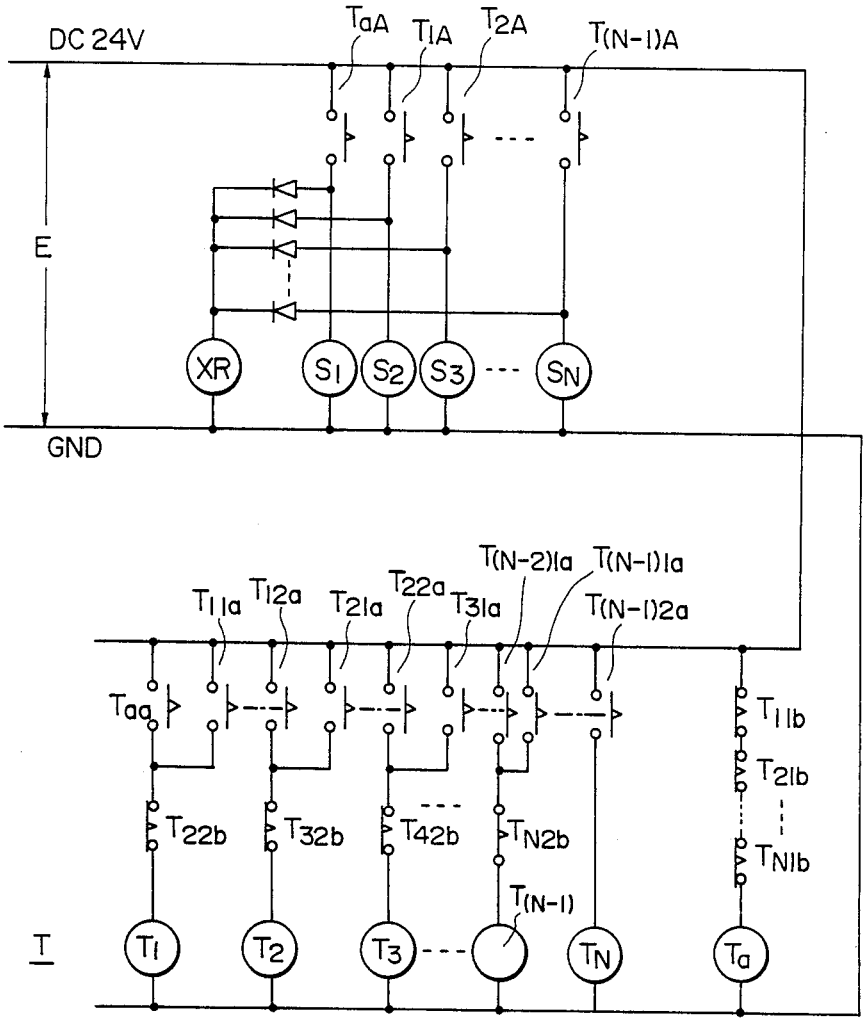
FIG. 4 is a diagram illustrating another example of a control circuit for the arrangement shown in FIG. 1(B).

FIGS. 3 and 4 show examples of control circuits applicable to the embodiment shown in FIG. 1(B). FIG. 3 shows a circuit applicable to the case in which the detection signals are generated by pressure switches P ($P_1$ and $P_N$ and FIG. 4 shows circuit applicable to the case where, instead of the pressure switches P ($P_1$ through $P_N$) timers T ($T_1$ through $T_N$) are employed. The operation of the circuits shown in FIGS. 3 and 4 will be described with reference to FIG. 1(B) and FIG. 2.

First, the operation of the circuit in FIG. 3 will be described. After the air supplying unit 9A has been started, the pressure of the pressurized air AO (air A1 in the closed chambers 3 of the fluid beds $BD_1$ through $BD_N$) reaches a predetermined value, the pressure switches $P_1$ through $P_N$ are operated to turn off the contacts $P_{1b}$ through $P_{Nb}$ ("b" contacts of the pressure switches $P_1$ through $P_N$) while the contacts $P_{1a}$ through $P_{(N-1)a}$ ("a" contacts of the pressure switches $P_1$ through $P_N$) are turned on.

The pressure switches $P_1$ through $P_N$ are incorporated into the circuit shown in FIG. 3 to which the voltage from the power source E is applied. The voltage is applied through the "b" contacts $X_{1b}$ through $X_{Nb}$ of the control relays $X_1$ through $X_N$ to the timer relay $T_a$, thus energizing the timer relay $T_a$. After a predetermined period of time, the "a" contact $T_{aa}$ of timer relay $T_a$ is turned on which in turn energizes the control relay $X_1$. Upon being energized, the relay $X_1$ is self-held because it turns its "a" contact $X_{1a}$ on. When relay $X_1$ is energized, the "b" contact $X_{1b}$ is turned off to deenergize the timer relay $T_a$. In addition, when the relay $X_1$ is energized, the "a" contact $X_{1A}$ is turned on so that an air supplying relay $X_R$ and a solenoid $S_1$ are energized. As a result, the air supplying unit 9A is started and the electromagnetic valve $MV_1$ is opened. Accordingly, pressurized air is supplied to the fluid bed $BD_1$ and the beads therein are fluidized. When the air pressure in the bed $BD_1$ reaches the operating pressure of the pressure switch $P_1$, the "b" contact $P_{1b}$ of the pressure switch $P_1$ is turned off to deenergize the control relay $X_1$ while the "a" contact $P_{1a}$ of the pressure switch $P_1$ is turned on, thus energizing the control relay $X_2$. The control relay $X_1$ is also self-held because it turns on its "a" contact $X_{2a}$ upon being energized. That is, the "a" contact $X_{1a}$ is turned off when control relay $X_1$ is deenergized and the "a" contact $X_{2a}$ is turned on when control relay $X_2$ is energized. With this sequence, the air supplying unit relay $X_R$ is continously energized but, instead of the solenoid $S_1$, the solenoid $S_2$ is energized. As a result, the electromagnetic valve $MV_1$ is closed and the valve $MV_2$ is opened. The beads in the bed $BD_2$ are thus fluidized instead of the beads in the bed $BD_1$. The fluidization is continued until the pressure in the bed $BD_2$ reaches the operating pressure of the pressure switch $P_2$.

Similarly, the control relays $X_3$ through $X_N$ are operated successively and the beads in the beds $BD_3$ through $BD_N$ are fluidized in the stated order.

While the control relays $X_1$ through $X_N$ are operated sequentially as described above so that the bed fluidization of the fluid beds is carried out, one of the "b" contacts $X_{1b}$ through $X_{Nb}$ of the relays $X_1$ through $X_N$ is turned off so that the timer relay $T_a$ is maintained deenergized. However, when the pressure switch $P_N$ of the last fluid bed $BD_N$ is operated to turn off its "b" contact $P_{Nb}$ to deenergize the control relay $X_N$, the "b" contact $X_{Nb}$ is turned on so that all the "b" contacts $X_{1b}$ through $X_{Nb}$ are turned on. The timer relay $T_a$ is thereby energized again so that the above-described operation is repeated. The intermittent bead fluidization of the fluid beds $BD_1$ through $BD_N$ is thus periodically carried out.

The operation of the circuit in FIG. 4 will now be described. When the voltage of the power source E is applied to the circuit shown in FIG. 4, the voltage is applied through the contacts $T_{11b}$ through $T_{Nb}$ of the timer relays $T_1$ through $T_N$ to the timer relay $T_a$ thus energizing the timer relays $T_a$. After being energized for a predetermined period of time, the contacts $T_{aa}$ and $T_{aA}$ of timer relay $T_a$ are turned on. As a result, the timer relay $T_1$ is energized to start its time counting operation. At the same time, the air supplying unit relay $X_R$ and the solenoid $S_1$ are energized to fluidize the beads of the fluid bed $BD_1$ as was described in the explanation of FIG. 3. After a predetermined period of time, the "a" contacts $T_{1A}$, $T_{11a}$ and $T_{12a}$ of the timer relay $T_1$ are turned on, while the "b" contact $T_{11b}$ is turned off at which time the timer relay $T_a$ is deenergized. In turn, contacts $T_{aa}$ and $T_{aA}$ are turned off. The air supplying unit relay $X_R$ is maintained in an energized state but, the solenoid $S_1$ is denergized and the solenoid $S_2$ is energized so that the fluidization of $BD_1$ ends and the fluidization of $BD_2$ begins. The timer relay $T_1$ is self-held because the contact $T_{11a}$ was turned on and the timer relay $T_2$ is energized to start its time counting operation because the contact $T_{12a}$ was turned on. After the timer relay $T_2$ is energized for a predetermined period, the "b" contact $T_{22b}$ of the timer relay $T_2$ is turned off to deenergize the relay $T_1$ and the "a" contacts $T_2$, $T_{22a}$ and $T_{2a}$ are turned on. When timer relay $T_1$ is deenergized, contacts $T_{11a}$, $T_{12a}$ and $T_{1A}$ are turned off and solenoid $S_2$ is deeneregized. Because contacts $T_2$, $T_{22a}$ and $T_{2A}$ were turned on when contact $T_{22B}$ was turned off, timer relay $T_2$ is self-held, timer relay $T_3$ is energized to start its time counting operation and the air supplying unit relay $X_R$ is maintained in an energized state with the solenoid $S_3$ now in an energized state. Thus, the bead fluidization of the fluid bed $BD_2$ is ended and bead fluidization of the fluid bed $BD_3$ is started.

When the count value of the timer relay T reaches its set value, the relay $T_4$ is energized in the same manner that the time relay $T_3$ was energized when timer relay $T_2$ reached its count value. As a result, the bead fluidization of the fluid bed $BD_4$ is carried out.

Similarly, the timer relays $T_4$ through $T_{(N-1)}$ are operated successively so that the intermittent bead fluidization of the fluid beds $BD_4$ through $BD_N$ is carried out. During this operation, the "b" contacts $T_{11b}$ through $T_{(n-1)1b)}$ of the timer relays $T_1$ through $T_{(N-1)}$ *are turned off sequentially one at a time in order to maintain the timer relay* $T_a$ in a deenergized state. When the time count value of the timer relay $T_N$ reaches its set value after the time count value of the timer relay $T_{(N-1)}$ reached its set value, the relay $T_N$ turns "b" contact $T_{N2b}$ off to deenergize the timer relay $T_{(N-1)}$. When the timer relay $T_{(N-1)}$ is deenergized, the "a" contact $T_{(N-1)2a}$ is turned off and the timer relay $T_N$ is deenergized at which time the "b" contact $T_{N1b}$ is turned on. As a result, the timer relay $T_a$ is energized again. Thus, the intermittent bead fluidization of the fluid beds $BD_1$ through $BD_N$ is periodically carried out.

What is claimed is:

1. A fluid bed system comprising:

a plurality of fluid beds, each comprising a plurality of bead-like members adapted to be suspended in pressurized air and a bead confining membrane;

distribution means for supplying each of said fluid beds with pressurized air;

pressurized-air supplying means in flow communication with said distribution means, said pressurized air supplying means being located remote from said fluid beds and being operable between off and on conditions;

a plurality of openable and closeable electrically actuated valves disposed in said distribution means for controlling the flow of pressurized air each of said fluid beds; and system control means for automatically opening and closing said actuated valves in cycles such that at least half of said valves are closed at all times and such that during each of said cycles each of said fluid beds is supplied with pressurized air, for controlling the pressurized-air supply means for continuously supplying pressurized air from said pressurized-air supplying means to said distribution means throughout each of said cycles, and for automatically turning said pressurized-air supplying means on and off.

2. The fluid bed system as recited in claim 1 wherein said system control means includes electric circuit means coupled to said electrically actuated valves and to said pressurized-air supplying means for selectively causing said electrically actuated valves to open and close and for turning on said pressurized-air supplying means when at least one of said valves is in an open position.

3. The fluid bed system as recited in claim 2 wherein said electric circuit means includes:

a timer circuit; and a plurality of sequentially operated bed control means, each of said bed control means individually opening a respective one of said electrically actuated valves while turning on said pressurized-air supplying means, wherein said timer circuit initiates operation of a first one of said bed control means at predetermined time intervals whereafter said first one of said bed control means initiates sequential operation of succeeding ones of said bed control means.

4. The fluid bed system as recited in claim 3 wherein said plurality of bed control means each includes a switching relay for initiating said sequential operation.

5. The fluid bed system as recited in claim 4 wherein each said plurality of bed control means further includes a switch responsive to said pressurized air in a fluid bed controlled by said respective one of said electrically actuated valves said switch for deenergizing said switching relay of the respective bed control means.

6. The fluid bed system as recited in claim 4 wherein each said switching relay of each of said plurality of bed control means is deenergized after a predetermined time period.

7. The fluid bed system as recited in claim 1 wherein said bead-confining membrane has a vertical thickness and wherein each of the plurality of fluid beds further comprises a closed chamber, said chamber being connected to said bead-confining membrane and having a vertical thickness, an air inlet for receiving pressurized air flow from said distribution means, and a porous top through which pressurized air may be diffused into the connected bead-confining membrane, said chamber and membrane being configured such that the minimum height at which the top of said fluid bed may be set substantially equals the combined vertical thicknesses of said closed chamber and said bead-confining membrane.

* * * * *